US005785549A

United States Patent [19]

Takayasu

[11] Patent Number: 5,785,549

[45] Date of Patent: Jul. 28, 1998

[54] FLEXIBLE BOARD ELECTRICAL CONNECTOR

[75] Inventor: Ryuichi Takayasu, Tokyo, Japan

[73] Assignee: Hirose Electric Co., Ltd., Tokyo, Japan

[21] Appl. No.: 740,950

[22] Filed: Nov. 5, 1996

[30] Foreign Application Priority Data

Nov. 9, 1995 [JP] Japan ..... 7-314878
Apr. 9, 1996 [JP] Japan ..... 8-111128

[51] Int. Cl.[6] ..... H01R 9/07

[52] U.S. Cl. ..... 439/495; 439/67

[58] Field of Search ..... 439/495, 494, 439/492, 493, 499, 329, 635, 630, 260, 67, 77, 60, 341, 326, 924.1

[56] References Cited

U.S. PATENT DOCUMENTS 4,367,006 1/1983 Rehbogen, Jr. et al. ..... 439/924.1
5,106,311 4/1992 Yodogawa et al. ..... 439/77
5,458,506 10/1995 Yamaguchi et al. ..... 439/495

*Primary Examiner*—Gary F. Paumen
*Assistant Examiner*—Tho D. Ta
*Attorney, Agent, or Firm*—Kanesaka & Takeuchi

[57] ABSTRACT

A flexible board electrical connector includes an insulating housing having an opening and a pair of holding sections on opposite sides of the opening; a plurality of contact elements having fulcrum sections and spring contact sections disposed in the opening; a pressure member attached to the holding sections for rotation between a closed position where it is close to the contact elements and an open position where it is spaced apart from the closed position; the insulating housing having receiving faces for supporting a leading portion of a flexible board; the pressure member having a pressure edge and bearing faces such that when the pressure member is turned to the closed position, the pressure edge depresses the flexible board between the spring contact sections and the receiving faces while the bearing faces engage the fulcrum sections of the contact elements thereby preventing separation between the pressure member and the contact elements.

3 Claims, 13 Drawing Sheets

FLEXIBLE BOARD ELECTRICAL CONNECTOR

BACKGROUND OF THE INVENTION

1. Field of the Invention

The present invention relates to electrical connectors for flexible boards.

2. Description of Related Art

Japanese patent application Kokai No. 142130/95 discloses an electrical connector of this type as shown in FIGS. 11–13. The spring contact sections 52A of contact elements 52 are disposed on an opening of a housing 51. The housing 51 has circular bearings on the opposite holding sections 53 for supporting a pressure member 54 for rotation (FIG. 11) between a closed position where the pressure member 54 is close to the contact elements 52 and an open position where the pressure member 54 is spaced from the closed position. The contact elements 52 are made by stamping a metal sheet so as to provide a fulcrum section 52B with their center aligned with the center of the circular bearings as shown in FIG. 12. The contact elements 52 are disposed in channels 51A of the housing 51 such that the fulcrum sections 52B form a comb-like cylindrical body or shaft between the circular bearings. The pressure member 54 has a concave bearing face 54A such that when the pressure member 54 rotates about the circular bearings, the bearing face **54*a* engages the comb-like shaft for rotation. The pressure member 54 has a pressure edge 54B for pressing a flexible board F against the spring contact sections 52A in the opening of the housing 51**.

As shown in FIG. 12, the housing 51 has receiving faces 51B at a position deeper than the spring contact sections 52A for raising the leading edge of the flexible board F so that when the pressure member 54 is turned downwardly to the closed position, the pressure edge 54B of the pressure member 54 applies a pressure on the flexible board F between the spring contact sections 52A and the receiving faces **51*b***.

In operation, first of all, the pressure member 54 is turned upwardly to the open position as shown by phantom line in FIG. 12, and a flexible board F is put into the opening such that the connection conductors of the board F face down. At this point, the flexible board F is supported by the spring contact sections 52A and the receiving faces 51B. Then, the pressure member 54 is turned downwardly to the closed position as shown in FIG. 13, so that the pressure edge 54B depresses the flexible board F between the spring contact sections 52A and the receiving faces 52B. Thus, the connection conditions of the flexible board F are electrically connected under a predetermined pressure to the spring contact sections 52A of the contact elements 52.

When the pressure edge 54B abuts the flexible board F, the pressure member 54 receives a moment of a force and is pushed forwardly (to the left in the figure), but the fulcrum sections 52B engage the concave bearing face 54A to prevent the forward movement of the pressure member 54.

However, if the flexible board F is thicker than the expected, the operational force upon the pressure member 54 is larger, making the forward moving force larger. If the forward moving force is very large, the bearing face 54A can slip away from the fulcrum sections 52B. Especially, when the number of contact elements 52 is large so that the pressure member 54 is elongated, it is more likely to separate because of a flexure of the pressure member 54 between the circular bearings.

SUMMARY OF THE INVENTION

Accordingly, it is an object of the invention to provide a flexible board electrical connector having a pressure member resistant to separation from the housing even if the number of contact elements is large and the pressure member is elongated.

It is another object of the invention to provide a flexible board electrical connector which is compact.

The first object is achieved by a flexible board electrical connector according to one aspect of the invention, which includes an insulating housing having an opening and a pair of holding sections on opposite sides of said opening; a plurality of contact elements having fulcrum sections and spring contact sections provided in said opening; a pressure member attached to said holding sections for rotation between a closed position where it is close to said contact elements and an open position where it is spaced apart from said closed position; said insulating housing having receiving faces for supporting a leading portion of a flexible board; said pressure member having a pressure edge and a bearing face such that when said pressure member is turned to said closed position, said pressure edge depresses said flexible board between said spring contact sections and said receiving faces while said bearing face engage said fulcrum sections of said contact elements thereby preventing separation between said pressure member and said contact elements.

When the pressure member is turned downwardly to the closed position, a reactive force pushes the pressure member outwardly for separation from the contact elements. However, the concave bearing faces of the pressure member engage the fulcrum sections of the contact elements so that the pressure member neither deforms nor comes off from the contact elements.

It is preferred that the spring contact sections are disposed in a zigzag fashion in at least two rows so that the reactive force is split and reduced, requiring lower operational forces. Consequently, the force tending to separate the pressure member from the contact elements is reduced, which in turn reduces the frequency that the pressure member comes off from the contact elements.

Since the receiving faces are provided at a deep position in the opening to support the leading portion of a flexible board upwardly to the pressure member, the flexible board is support by both the spring contact sections and the receiving faces so that the contact between the flexible board and the contact elements is stable and reliable.

The other object of the invention is achieved by a flexible board electrical connector according to another aspect of the invention, which includes an insulating housing having an opening and a pair of holding sections; a plurality of contact elements having spring contact sections disposed in the opening; a pressure member attached to the housing for rotation between a closed position where it is close to the contact elements and an open position where it is apart from the closed position; the contact elements being made of a substantially flat conductive sheet so as to provide fulcrum sections having arcuate tips with their axes extend in a direction of thickness of the conductive sheet; the pressure member having a pressure edge for depressing a flexible board against the contact elements and bearing face the engaging the fulcrum sections when the pressure member is turned downwardly to the closed position;

(A) the fulcrum sections projecting in the direction of thickness; and the pressure member having compartments for accommodating the fulcrum sections and the bearing faces or (B) the fulcrum sections having apertures and the pressure member having compartments for accommodating the fulcrum sections and the bearing faces, and studs or pin put through the apertures.

In the structure (A), the fulcrum sections project in the direction of thickness so that the fulcrum sections do not increase the height of the connector. The fulcrum sections are able to be accommodated in a space between adjacent contact elements so that it is unnecessary to increase the length of the connector.

In the structure (B), the studs or pin assures connection between the pressure member and the contact elements, and the contact elements are made substantially flat so that neither height nor length of the connector is increased.

DESCRIPTION OF THE PREFERRED EMBODIMENT

Figure 1:
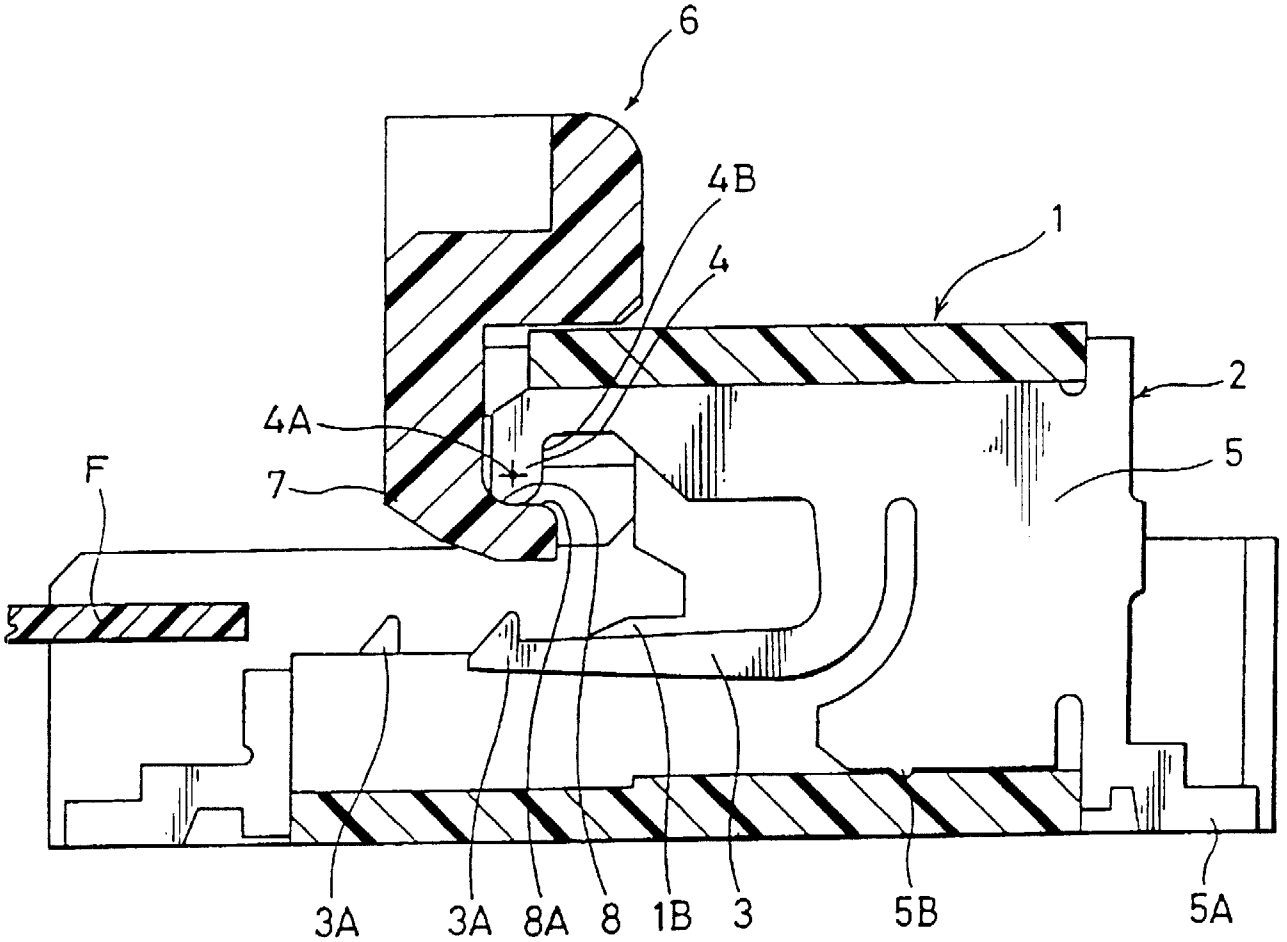
FIG. 1 is a sectional view of an electrical connector according to an embodiment of the invention, wherein a pressure member is at an open position.
Figure 11:
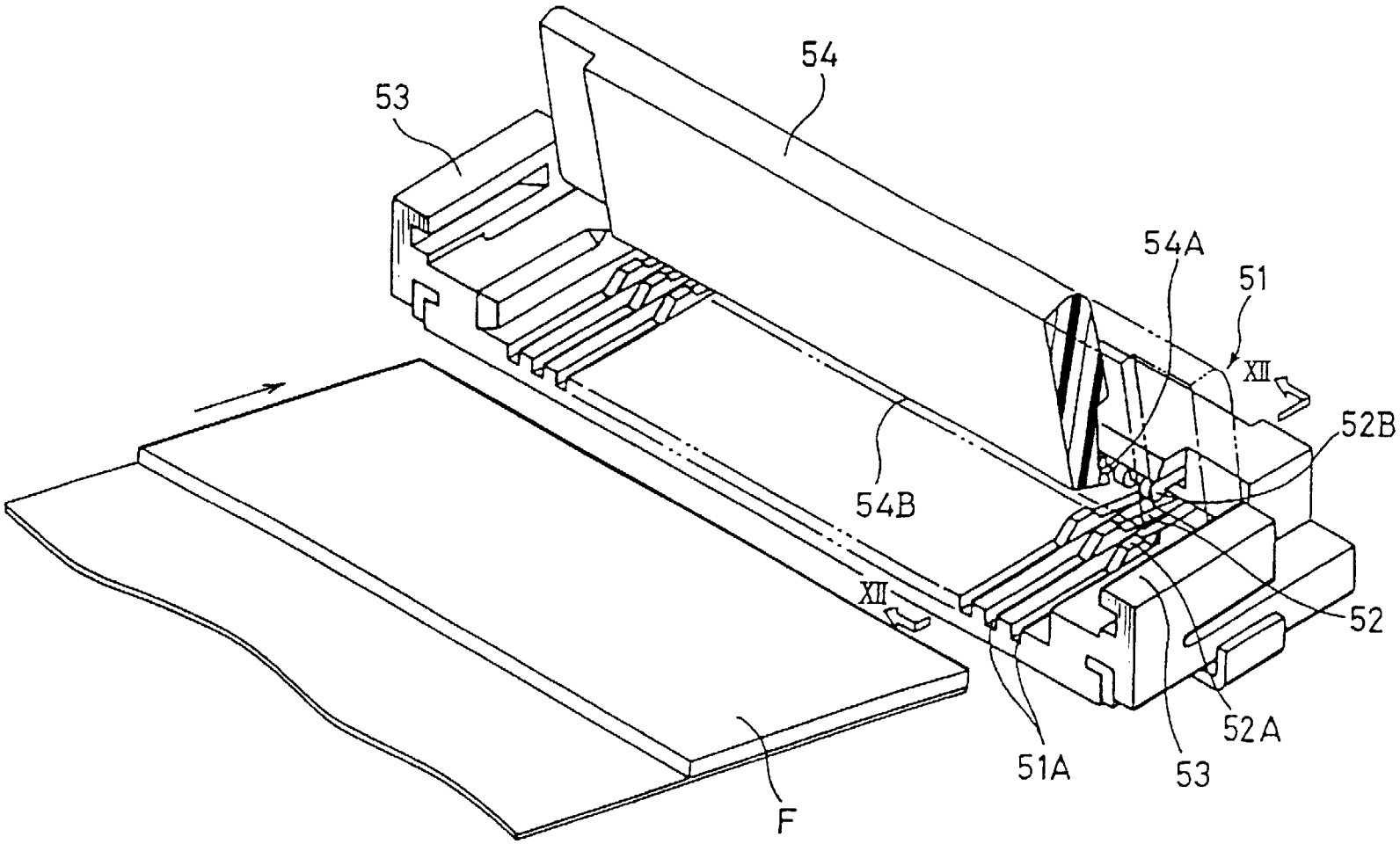
FIG. 11 PRIOR ART
FIG. 11 is a perspective view, partially in section, of a conventional electrical connector.
Figure 12:
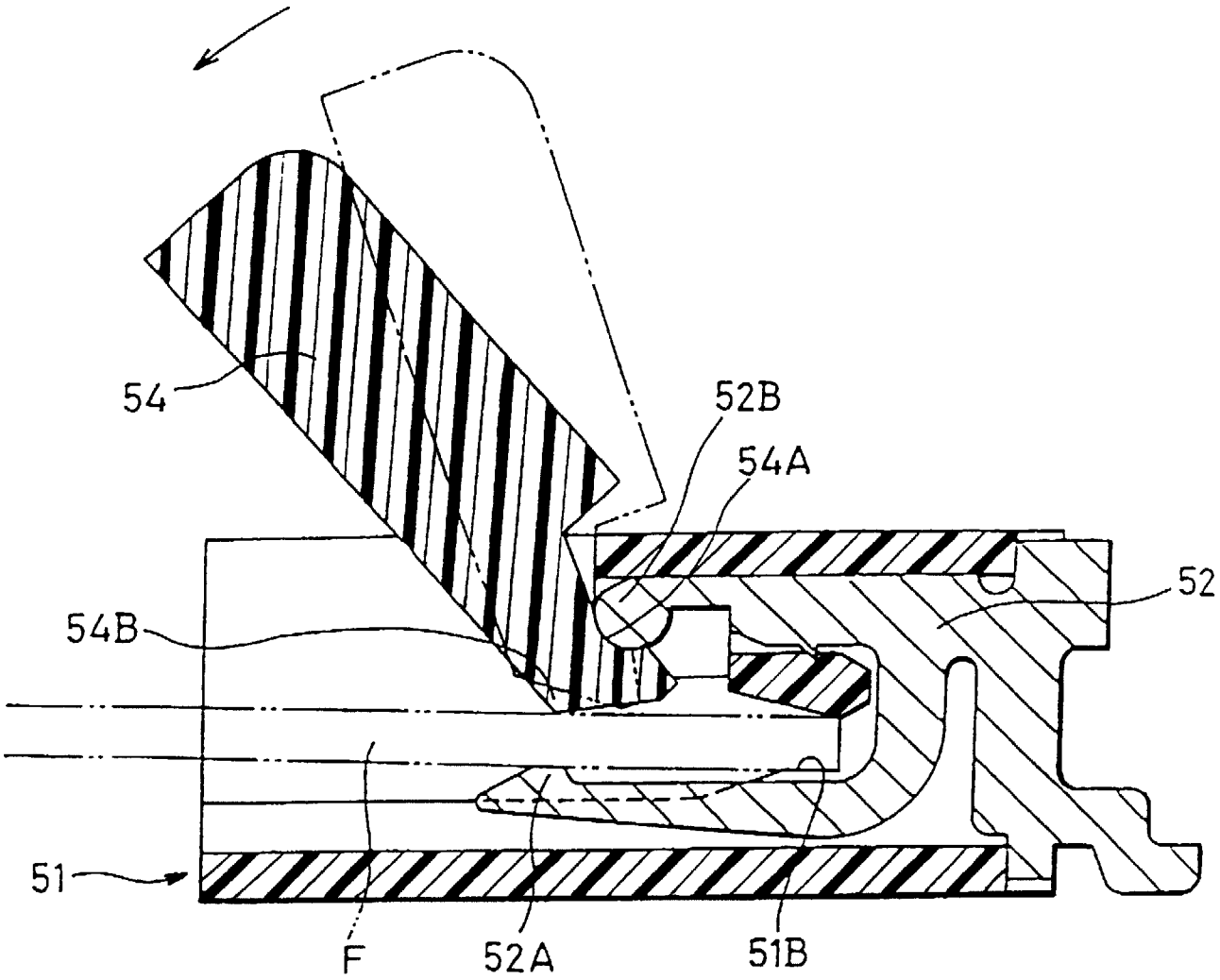
FIG.12 PRIOR ART
FIG. 12 is a sectional view taken along line XII—XII of FIG. 11.
Figure 13:
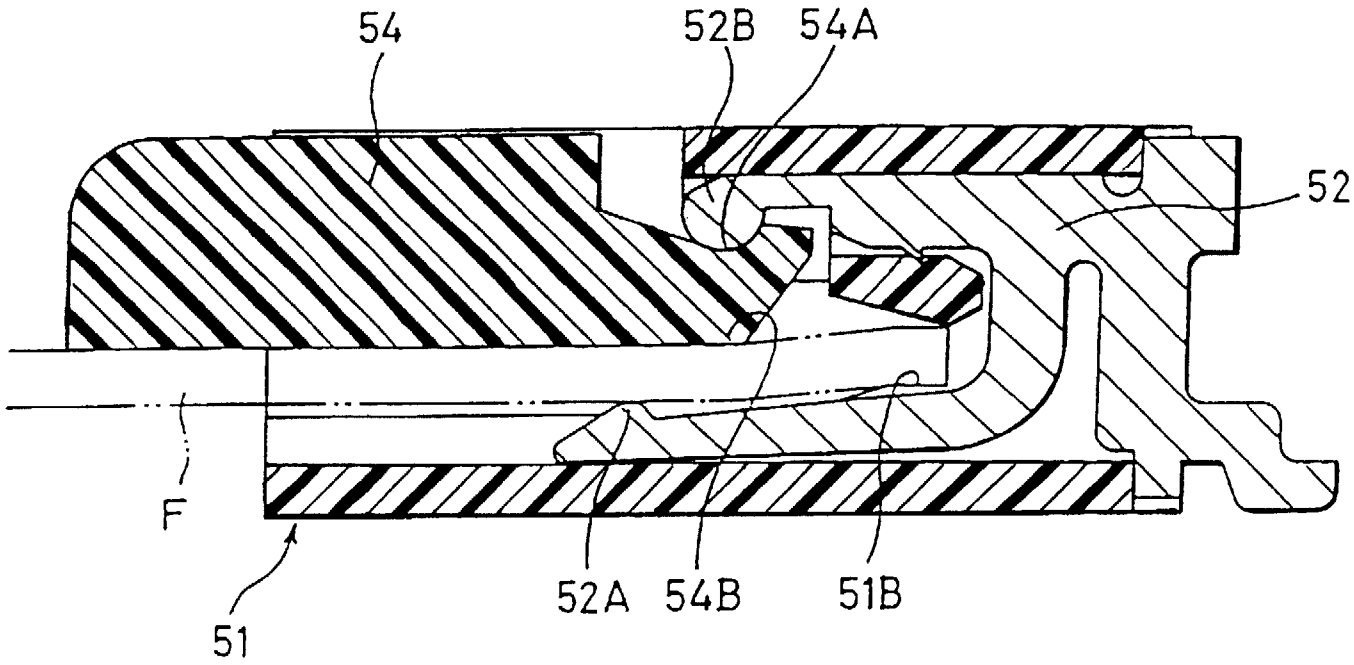
FIG. 13 PRIOR ART
FIG. 13 is a sectional view of the electrical connector of FIG. 11, wherein a pressure member is at a closed position.

In FIG. 1, a substantially rectangular elongated housing 1 is made of an insulating material and has an opening which extends in a longitudinal direction at an upper left edge. Like the conventional connector of FIG. 11, a pair of holding sections extend upwardly at opposite ends of the opening. A pair of circular bearings are provided on the holding sections. A plurality of retaining channels extend in parallel to and between the holding sections at regular intervals for retaining contact elements 2.

The contact elements 2 are made by stamping a sheet metal so as to provide a J-shaped finger section 3, a fulcrum section 4 with a semi-circular tip, and a linking section 5 for uniting both the sections 3 and 4. A connection section 5A extends outwardly from the linking section 5 such that when the connector is mounted on a circuit board, the connection section 5A is brought into contact with a predetermined conductor of the circuit board. A spring contact 3A projects from the finger section 3 toward the fulcrum section 4.

It is preferred that the contact elements 2 are disposed such that the spring contacts 3A are offset alternately in a zigzag fashion. The center 4A of the fulcrum section 4 is aligned with the center of the circular bearings of the housing 1. The contact elements 2 are press fitted into the retainer channels from the rear side (right side in the figure) up to a predetermined position where they are retained by projections 5B.

The retaining channels have receiving faces 1B slightly higher than the finger sections 3 of contact elements 2 for raising the leading edge of a flexible board. The elongated pressure member 6 is provided over the opening of the housing 1 for rotation. The pressure member 6 has a pressure edge 7 and a pair of studs extending outwardly from opposite ends. The studs of the pressure member 6 are supported by the semi-circular bearings of the housing 1 for rotation. The pressure member 6 has an arcuate bearing face 8 on the side opposite to the pressure edge 7 so as to engage the fulcrum sections 4 of contact elements 2. When the contact elements 2 are disposed in the retaining channels of the housing 1, the fulcrum sections 4 form a comb-like shaft for engaging the bearing face 8 of the pressure member 6. Since the fulcrum sections 4 are made of metal, the comb-like shaft is sufficiently strong to support the pressure member 6.

It is noted that the fulcrum sections 4 extend downwardly to such an extent that the center of rotation 4A is protruded to form a deep hook portion 4B while the bearing face 8 extends beyond the center of rotation 4A forming a hook portion 8A. Consequently, when the pressure member 6 turns and the pressure edge 7 abuts the flexible board, the hook portions 4B and 8A of the fulcrum sections 4 and bearing face 8 engage each other. The angled pressure edge 7 is made by two planes in this embodiment, but it may be rounded.

How to connect a flexible board to the electrical connector will be described below.

(1) As shown in FIG. 1, the pressure member 7 is turned upwardly to the open position to expose the opening of the housing 1. A flexible board F is then put into a space between the contact sections 3A of contact elements 2 and the pressure member 6 such that the connection side of the flexible board faces downward. The space is larger than the thickness of the flexible board F so that the board F is put into the space without difficulty, with the leading end raised by the receiving faces 1B of the housing 1.

Figure 2:
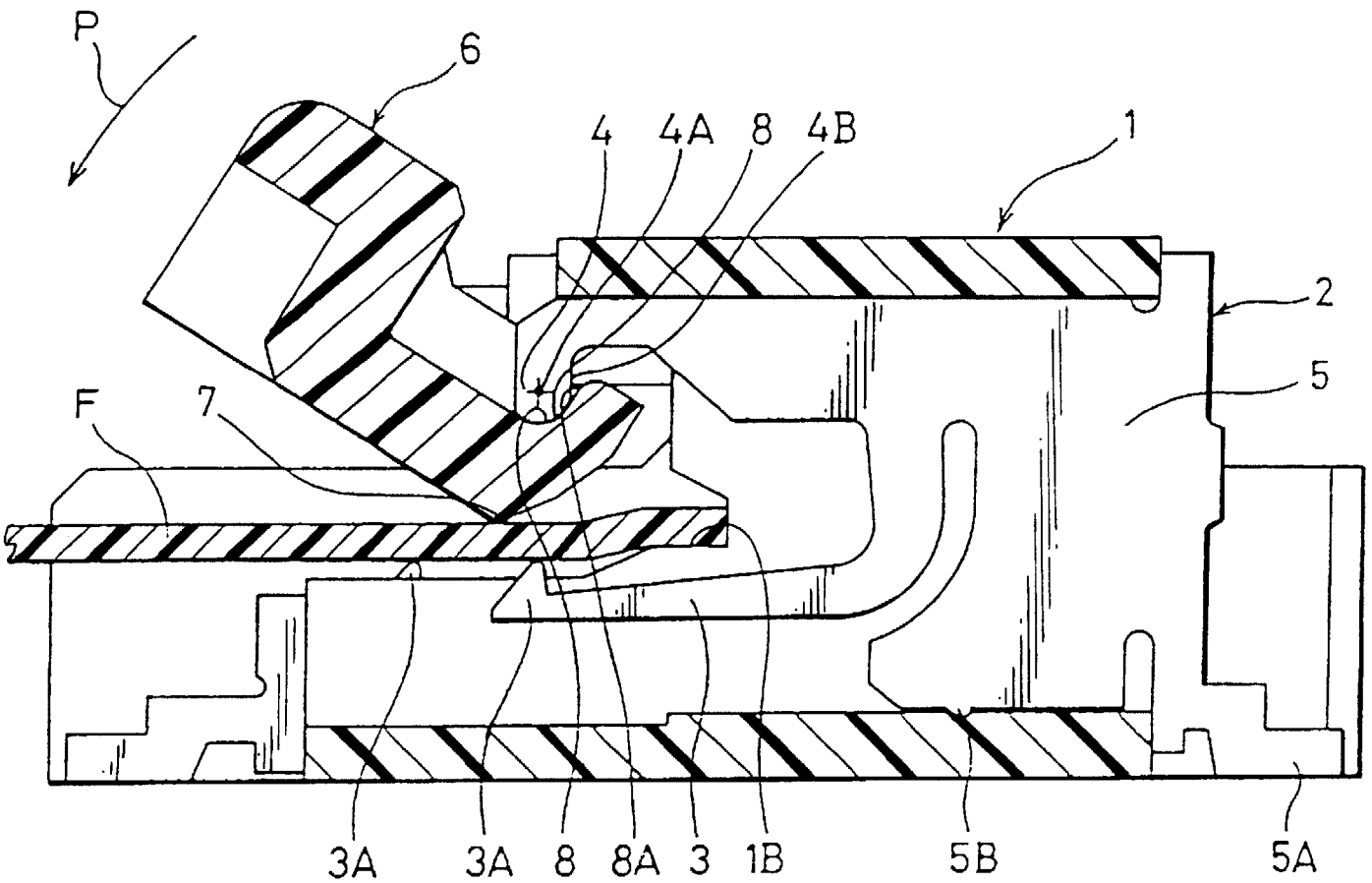
FIG. 2 is a sectional view of the electrical connector of FIG. 1, wherein the pressure member is in motion.

(2) Then, as shown in FIG. 2, the pressure member 6 is turned downwardly so that the pressure edge 7 abuts and depresses the flexible board F which is supported by the spring contact sections 3A of the contact elements 2 and the receiving faces 1B of the housing 1. Consequently, the flexible board F is flexed and brought into contact with the contact sections 3A under pressure. The pressure on the flexible board F by the pressure edge 7 takes the maximum value when the pressure edge 7 reaches a line drawn across the center 4A of the fulcrum sections 4 and the adjacent spring contact sections 3A. When the pressure edge 7 depresses the flexible board F, the bearing face 8 abuts the fulcrum sections 4 with a force proportional to the operational moment of a force P. However, the hook portions 4B and 8A engage each other so that the pressure member 6 does not come off from the fulcrum sections 4. In this embodiment, the spring contact sections 3A of contact elements 2 are disposed in a zigzag fashion so that the maximum value of operational pressure is reduced.

Figure 3:
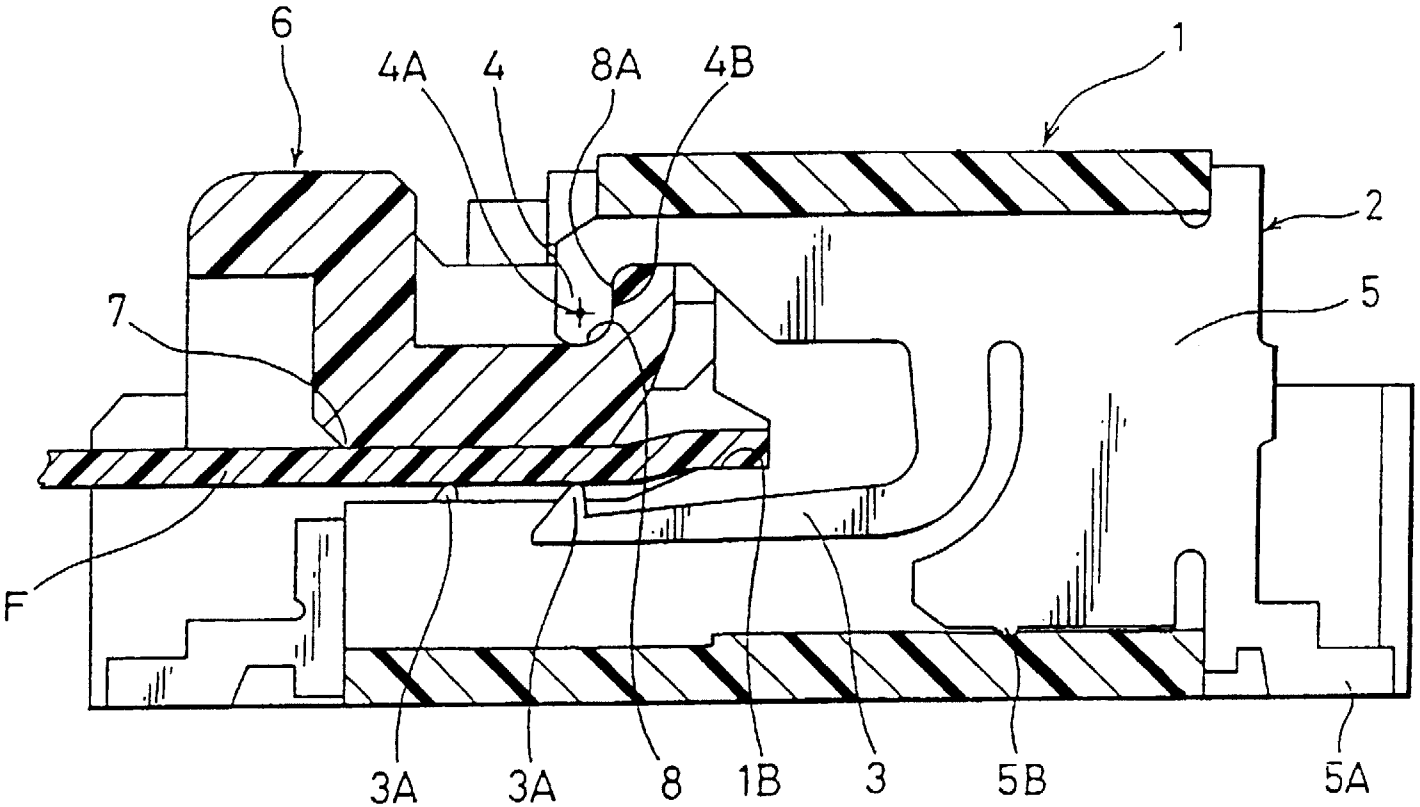
FIG. 3 is a sectional view of the electrical connector of FIG. 1, wherein the pressure member is at a closed position.

(3) When the pressure member 6 is further turned, the pressure edge 7 enters the housing 1 and passes the maximum value point, and the pressure member 6 is brought to the closed position as shown in FIG. 3. The pressure at this point is less than the maximum value but still sufficiently large to maintain the contact between the flexible board F and the spring contact sections 3A of contact elements 2.

(4) Once the flexible board F is connected to the contact elements 2, even if the flexible board F is pulled so that the pressure member 7 receives a force tending to turn the pressure member 6 to the opening position, the pressure member 6 does not open easily because the pressure edge 7 is located inside with respect to the maximum pressure value position and the reactive force tends to turn the pressure member 6 to the closed position. Thus, the connection between the flexible board F and the contact elements 2 is maintained unless a force larger than the maximum pressure is applied to the pressure member 6.

Alternatively, the fulcrum sections 4 may be made separate from the contact elements 2.

Figure 4:
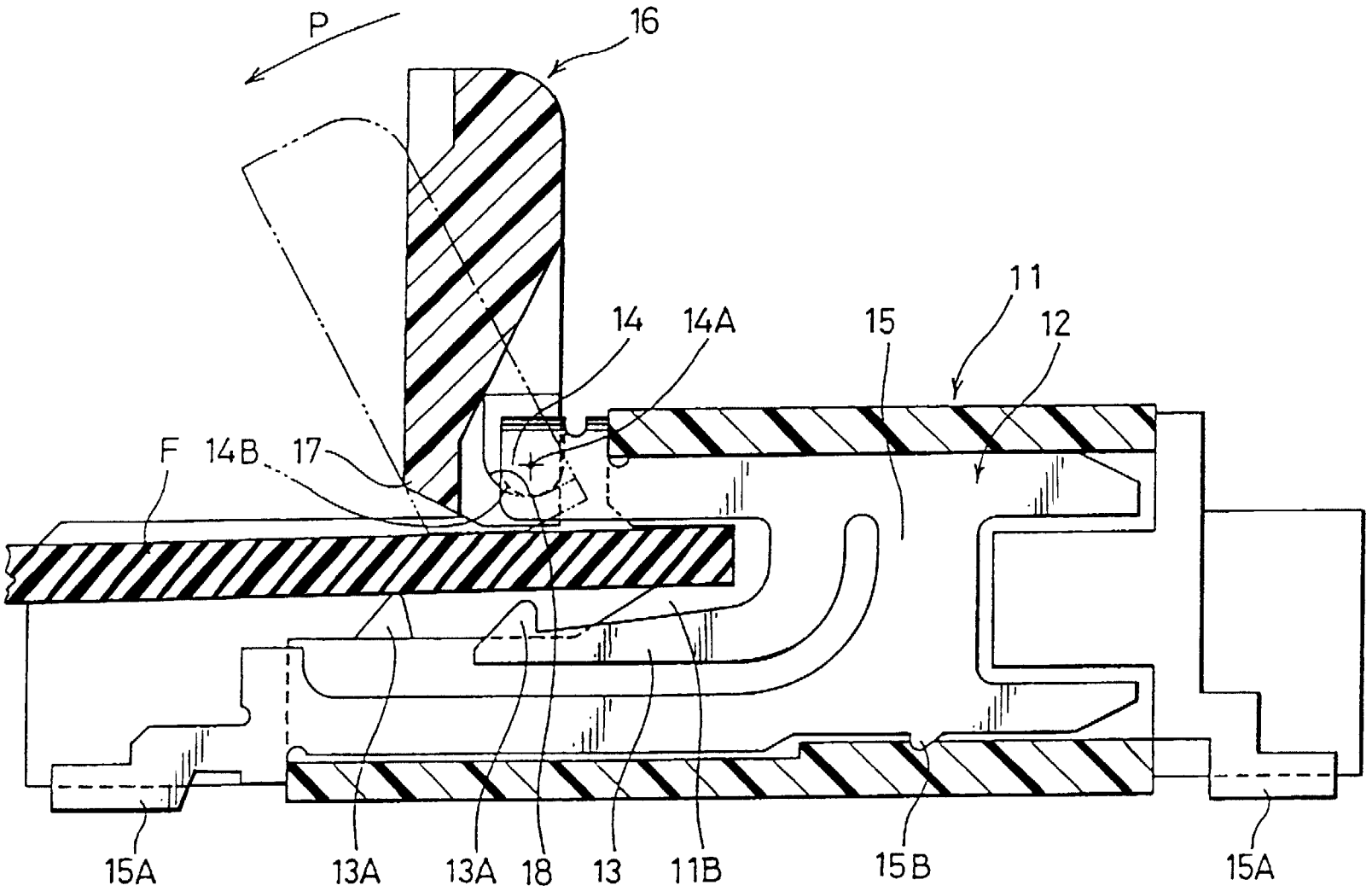
FIG. 4 is a sectional view of an electrical connector according to a second embodiment of the invention, wherein a pressure member is at an open position.

In FIG. 4, a housing 11 is made of an insulating material and has an opening in the upper left quarter. Like the conventional connector of FIG. 11, the housing 11 has a pair of holding sections on opposite sides of the opening. Arcuate bearings are provided on the holding sections. Retention channels are provided in the opening between the holding sections at regular intervals for retaining contact elements.

The contact elements 12 are made by stamping and forming a conductive or metallic sheet to provide a finger section 13, a fulcrum section 14, a connection section 15A, and a linking section for uniting these sections 13, 14, and 15A. The useful conductive materials include metal sheet, metallized sheet, and sheet containing conductive substance. The connection section 15A extends outwardly from the linking section 15 to a level substantially equal to the bottom of the housing 11 so that when the housing 11 is mounted on a circuit board, it is brought into contact with the desired conductor on the circuit board for soldering. A spring contact portion 13A extends from a tip of the finger section 13 toward the fulcrum section 14.

The contact elements 12 are disposed such that the spring contact sections 13A are offset alternately in a zigzag fashion. Also, the connection sections 15A are projected alternately from the left and right sides of the housing 11. The center 14A of the fulcrum sections 14 is aligned with the center of the arcuate bearings of the housing 11. The contact elements 12 are press fitted in the retaining channels from alternately the left and right sides of the housing 11 up to a predetermined position where they are retained by projections 15B. Receiving faces 11B are provided in the housing 11 so as to be slightly higher than the finger sections to support the leading edge of a flexible board.

An elongated pressure member 16 is provided on the opening of the housing 11 for rotation. The pressure member 16 has a pressure edge 17 and a pair of studs extending outwardly from its opposite ends. These studs of the pressure member 16 are put in the semi-circular bearings of the housing 11 for rotation. An arcuate bearing face 18 is provided on the pressure member 16 on the side opposite to the pressure edge 17 so as to engage the fulcrum sections 14 when the pressure member 16 is attached to the housing 11. When the contact elements 12 are put in the retaining channels of the housing 11, the fulcrum sections 14 form a comb-like shaft which engages the bearing face 18 of the pressure member 16. Since the fulcrum sections 14 are made of metal, the comb-like shaft is very strong.

Figure 6:
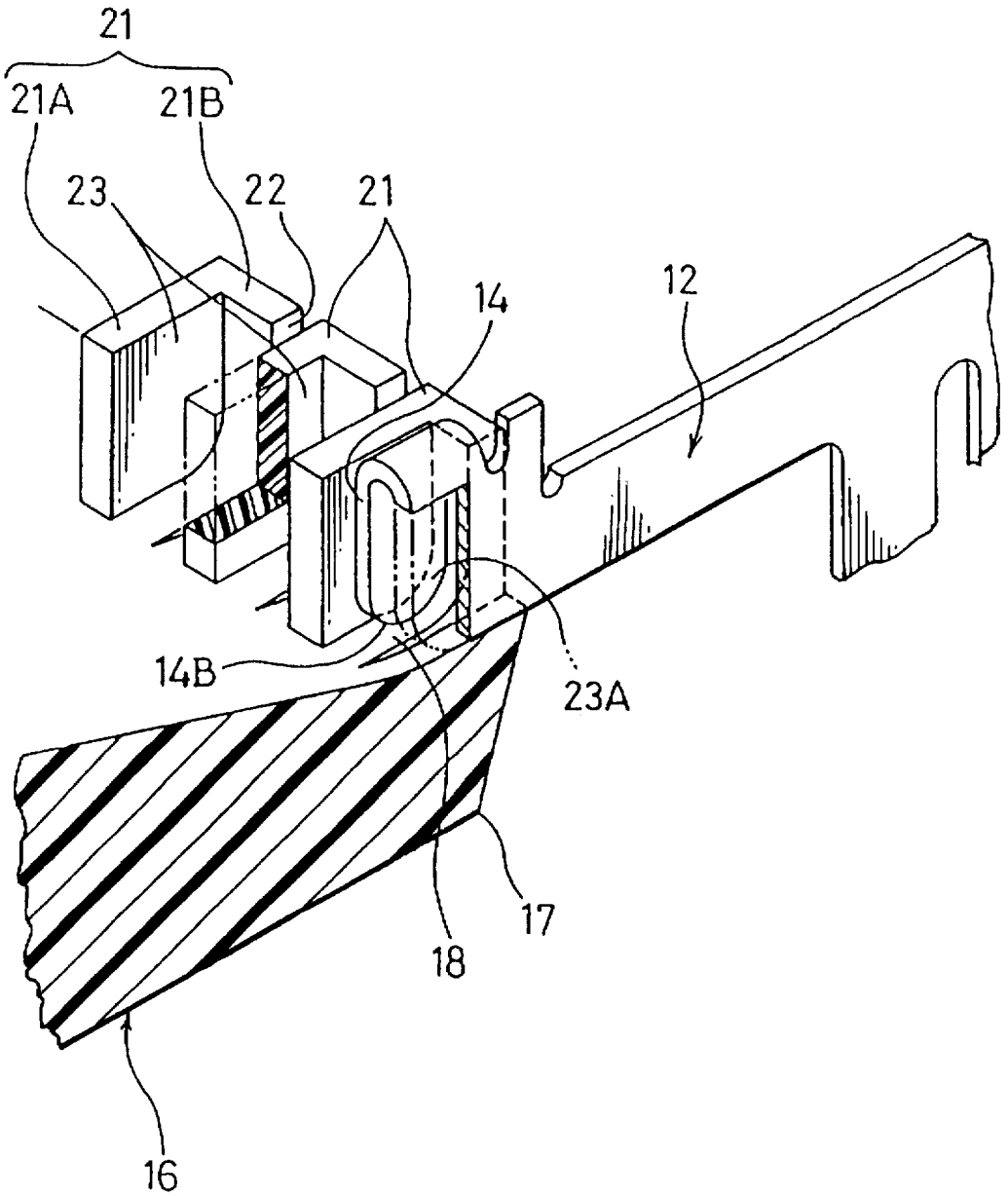
FIG. 6 is a perspective view showing the fulcrum sections of contact elements and the bearing faces of the pressure member of FIG. 4.

As shown in FIG. 6, the contact elements 12 are made by stamping a metal sheet and bending its part in a U-shaped form so as to provide a fulcrum section 14B. That is, the fulcrum sections 14 are not made higher than the conventional contact elements but formed within the space between the adjacent contact elements. Partition walls 21 are provided on the bearing face 18 of the pressure member 16 at intervals equal to the intervals of the contact elements. Each partition wall 21 consists of a longitudinal wall 21A and a lateral wall 21B. Slits 22 are provided between the adjacent lateral walls 21B. Receiving compartments 23 are provided between the adjacent longitudinal walls 21A for accommodating the fulcrum sections 14. Arcuate bearing faces 23A are provided on the pressure member 16 from the receiving compartments 23 to the lateral walls 21B. The radius of curvature of the bearing faces 23A is set to be equal to or slightly larger than that of the fulcrum sections 14B.

The electrical connector is connected to a flexible board as follows:

(1) As shown in FIG. 4, the pressure member 17 is turned upwardly to open the housing 11, and a flexible board F is put into a space between the pressure member 16 and the contact sections 13A of contact elements 12 such that the connection section of the flexible board F faces downward. Under this condition, the space is so large with respect to the thickness of the flexible board F that it is easy to put the flexible board F in the space, with the leading end raised by the receiving faces 11B of the housing 11.

Figure 5:
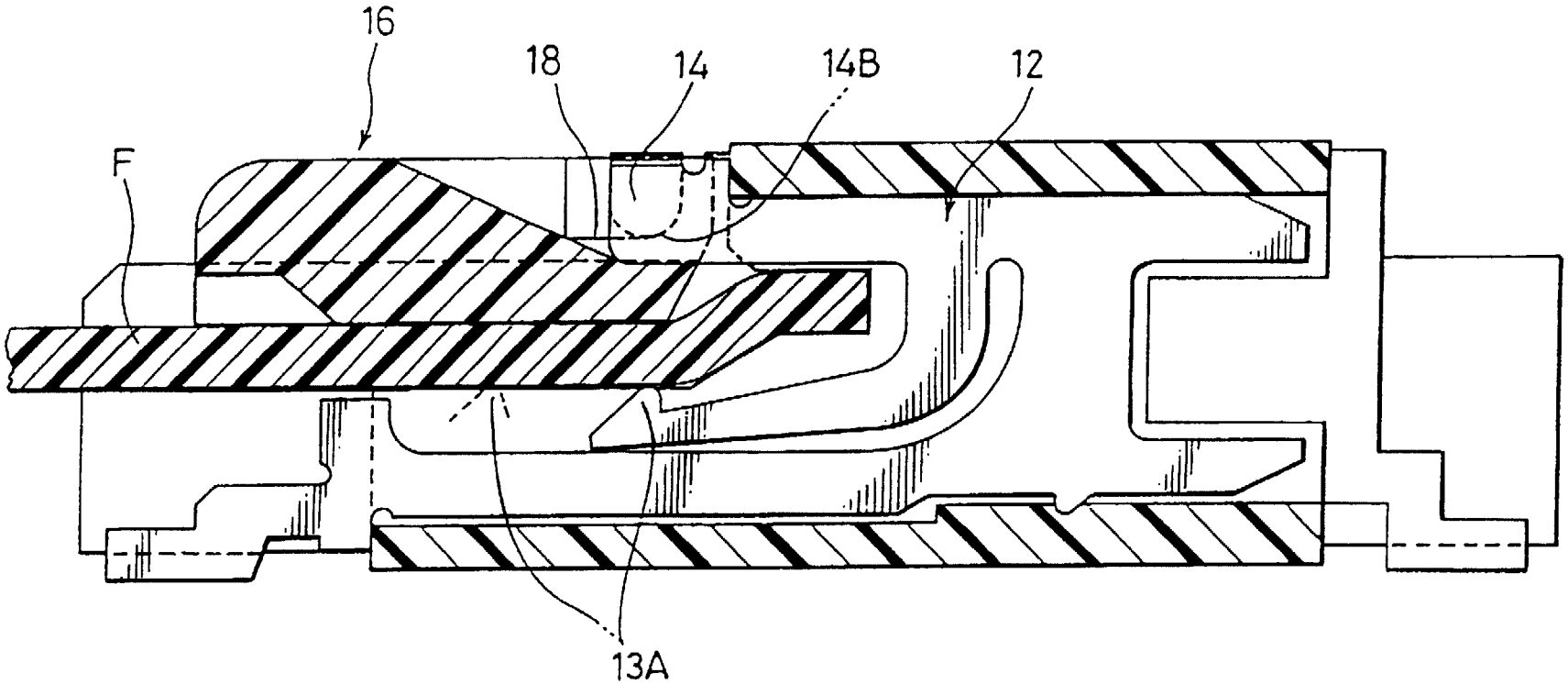
FIG. 5 is a sectional view of the electrical connector of FIG. 4, wherein the pressure member is at a closed position.

(2) Then, as shown by phantom line in FIG. 4, the pressure member 16 is turned downwardly to the closed position in FIG. 5 so that the pressure edge 17 abuts and depresses the flexible board F which is supported by the spring contact sections 13A of contact elements 12 and the receiving faces 11B of the housing 11. Consequently, the flexible board F flexes and contacts the contact sections 13A under pressure. The pressure on the flexible board F by the pressure edge 17 takes the maximum value when the pressure edge 17 reaches a line drawn across the center 14A of the fulcrum sections 14 and the adjacent spring contact sections 13A. When the pressure edge 17 depresses the flexible board F, the bearing face 18 pushes the fulcrum sections 14 with a force responsive to an operational moment of a force P tending to come off from the fulcrum sections 14. However, the lateral walls 21B of the pressure member 16 engage the fulcrum sections 14 so as to prevent the pressure member 16 from being deformed and coming off from the fulcrum sections 14.

(3) Once the flexible board F is connected to the contact elements 12, even if a pulling force is applied to the flexible board F to turn the pressure member 16 to the open position, the pressure member 16 does not open readily because the reactive force from the flexible board F produces a moment tending to close the pressure member 16. Thus, the connection between the flexible board F and the contact elements 2 is maintained unless a force greater than the maximum value is applied to the pressure member 16.

Figure 7:
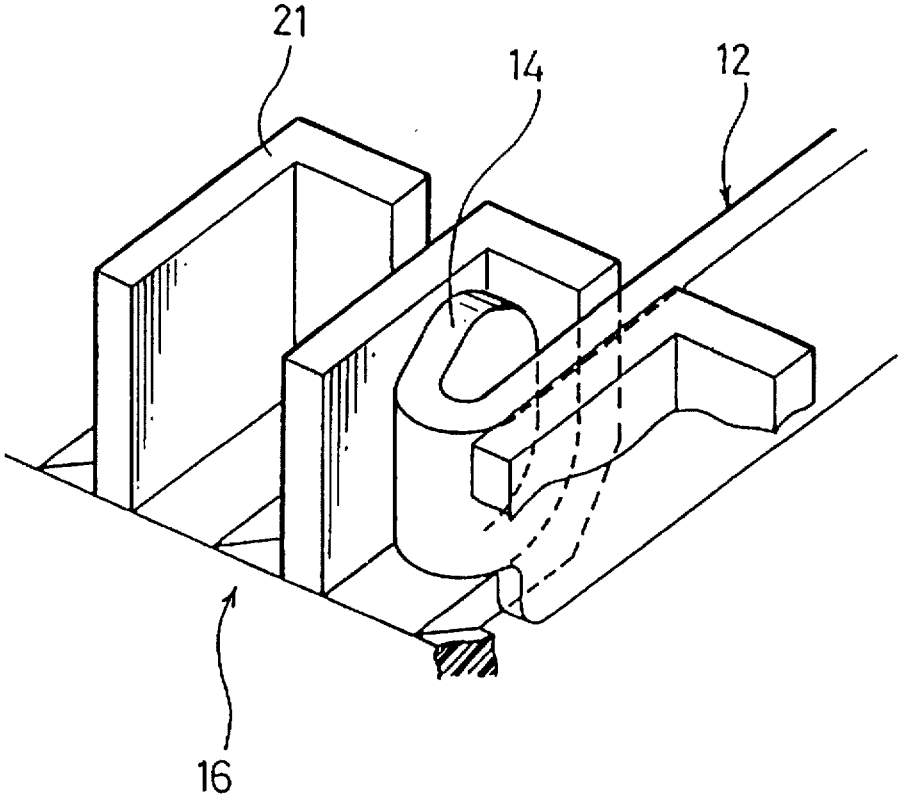
FIG. 7 is a perspective view showing a modified fulcrum section of a contact element.

Alternatively, the fulcrum sections 14 may be formed as shown in FIG. 7. That is, the fulcrum sections 14 are folded back instead of folded down in FIG. 6.

Figure 8:
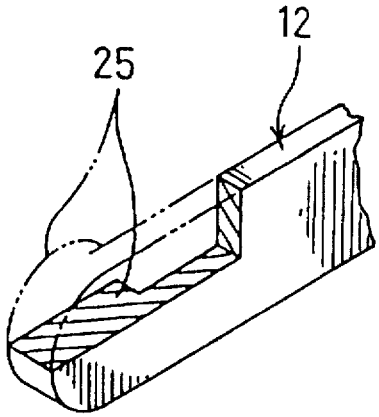
FIG. 8 is a perspective view showing another modification to the fulcrum section of a contact element.

The fulcrum sections 14 may be made with a stud 25 as shown in FIG. 8. The stud 25 may be made by a press machine or bonding a circular sheet.

Figure 9:
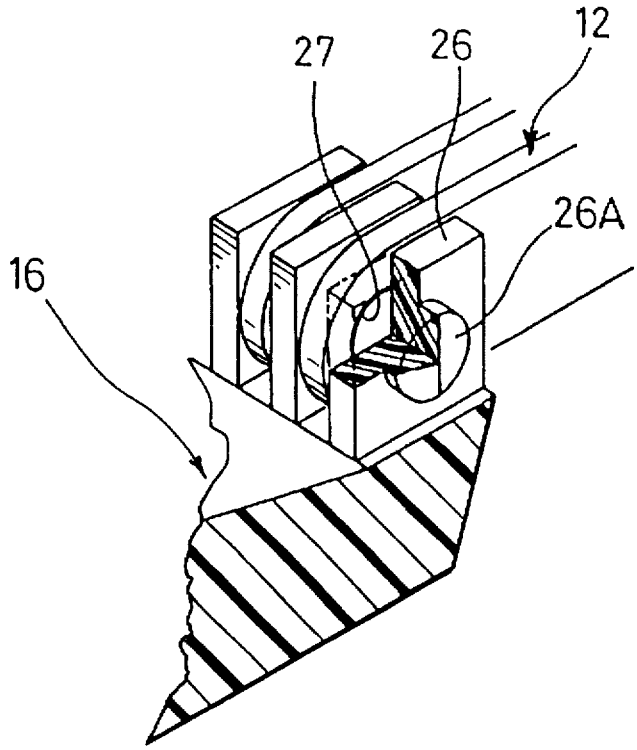
FIG. 9 is a perspective view showing still another modification to the fulcrum section and the bearing face of a pressure member.

Conversely, stud 26A may be provided on the longitudinal walls 26 of the pressure member 16 as shown in FIG. 9.

Unlike the bearing faces of FIGS. 5 and 7, no lateral wall is required in this embodiment. The fulcrum sections 27 have a corresponding aperture.

Figure 10:
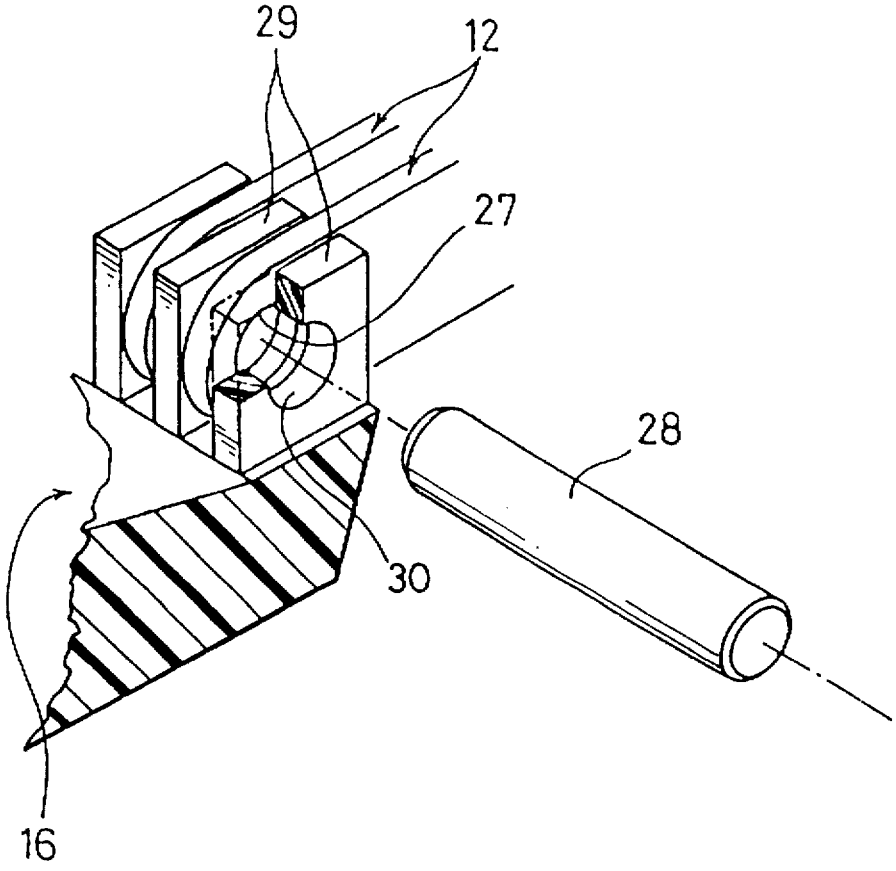
FIG. 10 is a perspective view showing yet another modification to the fulcrum section and the bearing sections.

The studs 26A may be replaced by a separate pin 28 as shown in FIG. 10. The pin 28 is put through the apertures 27 of contact elements 12. Also, apertures 30 are provided in longitudinal walls 29 of the pressure member 16 for receiving the pin 28.

As described above, according to an aspect of the invention, the bearing face of the pressure member engage the fulcrum sections of contact elements so that the pressure member does not come off easily from the fulcrum sections, resulting in the more reliable connector. The spring contact sections of contact elements are offset in a zigzag fashion so that the operational force is reduced, thereby further reducing not only the frequency of separation of the pressure member but also the required strength of material.

According to another aspect of the invention, the fulcrum sections of contact elements extend downwardly to provide a deep hook portion thereby preventing the pressure member from coming off from the housing without increasing the distance between the contact elements and thus the width of the entire connector. Where studs are provided on the pressure member, the contact elements are able to be made flat, thereby minimizing not only the arranging pitch but also the height of contact elements while preventing separation of the pressure member.

What is claimed is:

1. A flexible board electrical connector, comprising:

an insulating housing having an opening and a pair of holding sections on opposite sides of said opening;

a plurality of contact elements having fulcrum sections and spring contact sections disposed in said opening, said fulcrum sections extending downwardly to such an extent that a center of rotation is protruded to form deep hook portions;

a pressure member attached to said holding sections for rotation between a closed position where it is close to said contact elements and an open position where it is spaced apart from said closed position;

said insulating housing having receiving means for supporting a leading portion of a flexible board;

said pressure member having a pressure edge and bearing means with a hook portion extending beyond said center of rotation such that when said pressure member is turned to said closed position, said pressure edge depresses said flexible board at a point between said spring contact sections and said receiving means while said hook portion of said bearing means engages said deep hook portions of said fulcrum sections of said contact elements thereby preventing separation between said pressure member and said contact elements.

2. A flexible board electrical connector according to claim 1, wherein said receiving means is located at a position deeper than that of said spring contact sections for supporting said leading portion of said flexible board toward said pressure member.

3. A flexible board electrical connector, comprising:

an insulating housing having an opening, a pair of holding sections on opposite sides of said opening, and receiving means between said holding sections;

a plurality of first and second contact elements having fulcrum sections and spring contact sections disposed alternately in said opening, with said spring contact sections of said first contact elements being shorter than those of said second contact elements;

a pressure member attached to said holding sections for rotation between a closed position where it is close to said contact elements and an open position where it is spaced apart from said closed position;

said pressure member having a pressure edge and bearing means such that as said pressure member is turned to said closed position, said pressure edge first abuts on said flexible board at a first point between said first and second spring contact sections and then depresses said flexible board at a second point between said first spring contact sections and said receiving means, thereby minimizing reactive forces of said contact elements.

* * * * *